US008044884B2

(12) United States Patent
Jung et al.

(10) Patent No.: US 8,044,884 B2
(45) Date of Patent: Oct. 25, 2011

(54) PLASMA DISPLAY APPARATUS AND DRIVING METHOD THEREOF

(75) Inventors: Yun Kwon Jung, Gumi si (KR); Hyun Jae Lim, Namyangjoo-si (KR); Sung Kwang Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 738 days.

(21) Appl. No.: 11/447,166

(22) Filed: Jun. 6, 2006

(65) Prior Publication Data

US 2007/0171151 A1 Jul. 26, 2007

(30) Foreign Application Priority Data

Jan. 21, 2006 (KR) ..... 10-2006-0006557

(51) Int. Cl.
*G09G 3/24* (2006.01)

(52) U.S. Cl. ..... 345/60

(58) Field of Classification Search ..... 345/60–69
See application file for complete search history.

(56) References Cited

U.S. PATENT DOCUMENTS

| | | | | |
|---|---|---|---|---|
| 6,686,912 | B1 * | 2/2004 | Kishi et al. | 345/211 |
| 7,321,346 | B2 * | 1/2008 | Jung et al. | 345/68 |
| 7,417,603 | B2 * | 8/2008 | Kim et al. | 345/60 |
| 7,768,481 | B2 * | 8/2010 | Jung et al. | 345/68 |
| 2004/0246206 | A1 * | 12/2004 | Choi | 345/60 |
| 2004/0262044 | A1 * | 12/2004 | Schaaf | 175/61 |
| 2005/0168410 | A1 | 8/2005 | Tomio et al. | |
| 2005/0219153 | A1 * | 10/2005 | Kim et al. | 345/60 |
| 2006/0001610 | A1 * | 1/2006 | Kang et al. | 345/67 |
| 2006/0055635 | A1 * | 3/2006 | Choi | 345/60 |
| 2006/0181489 | A1 * | 8/2006 | Jung et al. | 345/67 |
| 2006/0262044 | A1 * | 11/2006 | Lee et al. | 345/68 |
| 2008/0042935 | A1 * | 2/2008 | Kim et al. | 345/68 |

FOREIGN PATENT DOCUMENTS

| | | |
|---|---|---|
| CN | 1689061 | 10/2005 |
| EP | 1 065 650 A2 | 1/2001 |
| EP | 1 548 694 A1 | 6/2005 |
| EP | 1 566 789 A2 | 8/2005 |
| EP | 1 587 051 A2 | 10/2005 |
| EP | 1 724 745 A1 | 11/2006 |
| JP | 2004-199026 | 7/2004 |
| JP | 2005-043413 | 2/2005 |
| KR | 10-2003-0033717 | 5/2003 |
| KR | 10-2005-0093886 | 9/2005 |

OTHER PUBLICATIONS

European Search Report dated Apr. 23, 2007.
European Office Action dated Aug. 9, 2007.
European Office Action dated Jan. 1, 2008.
Chinese Office Action dated May 23, 2008.
European Search Report dated Jul. 29, 2009.

* cited by examiner

*Primary Examiner* — Bipin Shalwala
*Assistant Examiner* — Matthew Fry
(74) *Attorney, Agent, or Firm* — KED & Associates LLP

(57) ABSTRACT

A plasma display apparatus comprises a driver for supplying a rising signal of finite slope and a scan signal of negative polarity to a scan electrode using one voltage source. The driver also supplies a falling signal to the scan electrode using the same voltage source. This apparatus may be used to perform a panel driving method that includes applying a rising signal, which rises from a first voltage to a second voltage, to the scan electrode during a reset period and applying a scan signal, of a magnitude at least substantially the same as a difference between the first voltage and the second voltage, to the scan electrode during an address period.

7 Claims, 11 Drawing Sheets

PLASMA DISPLAY APPARATUS AND DRIVING METHOD THEREOF

This Nonprovisional application claims priority under 35 U.S.C. §119(a) on Patent Application No. 2005-0006557 filed in Korea on Jan. 21, 2006 the entire contents of which are hereby incorporated by reference.

BACKGROUND OF THE INVENTION

1. Field of the Invention

This document relates to a display device, and more particularly, to a plasma display apparatus and a driving method thereof.

2. Description of the Background Art

In general, a plasma display apparatus among a display device comprises a plasma display panel and a driver for driving the plasma display panel.

In a plasma display panel, one unit cell is formed at a space between barrier ribs formed between a front panel and a rear panel. A main discharge gas such as Neon (Ne), Helium (He), or a mixture (He+Ne) of Neon and Helium and an inert gas containing a small amount of Xenon (Xe) are filled in each cell.

A plurality of discharge cells constitutes one pixel. For example, a red color (R) cell, a green color (G) cell, and a blue color (B) cell constitute one pixel.

In the plasma display panel, when discharge occurs using a high frequency voltage, the inert gas generates vacuum ultraviolet rays and phosphors provided between the barrier ribs are emitted, thereby realizing an image.

The plasma display panel is considered as one of the next generation display devices due to its thin profile and light weight construction.

In the plasma display panel, a plurality of electrodes, for example, a scan electrode (Y), a sustain electrode (Z), an address electrode (X) are formed, and a predetermined driving voltage is supplied to the plurality of electrodes to generate discharge, and so that an image is embodied.

In this way, a driver for supplying a predetermined driving voltage in order to embody an image is connected to electrodes of a plasma display panel.

For example, a data driver is connected to the address electrode (X) and a scan driver is connected to the scan electrode (Y), among the electrodes of the plasma display panel.

The plasma display apparatus comprises a plasma display panel in which a plurality of electrodes is formed and a driver for supplying a predetermined driving voltage to the plurality of electrodes of the plasma display panel.

In a conventional plasma display apparatus, a plurality of voltage sources is used to generate a driving voltage for supplying to the electrodes of the plasma display panel.

For example, a sustain voltage source is used to supply a sustain voltage (Vs) of a sustain signal to the scan electrode (Y) of the plasma display panel, a set-up voltage source is used to supply a voltage of a ramp-up signal, i.e., a set-up voltage, and a negative scan voltage source is used to supply a voltage of a ramp-down signal, i.e., a set-down voltage and a negative scan voltage of a scan signal.

In the conventional plasma display apparatus, because a plurality of voltage sources is used, there is a problem that the entire drive is complicated and a total production cost of the plasma display apparatus increases.

SUMMARY OF THE INVENTION

Accordingly, an object of the present invention is to solve at least the problems and disadvantages of the background art.

Embodiments of the present invention is to provide a plasma display apparatus which can reduce a total production cost by integrating two or more different voltage sources into one common voltage source.

According to an aspect of the present invention, there is provided a plasma display apparatus comprising: a plasma display panel comprising a scan electrode; and a driver for supplying a voltage of a rising signal with a gradually rising voltage and a voltage of a scan signal of a negative polarity direction, which are supplied to the scan electrode, using one voltage source.

According to another aspect of the present invention, there is provided a plasma display apparatus comprising: a plasma display panel comprising a scan electrode; and a driver for supplying a voltage of a rising signal with a gradually rising voltage, a voltage of a falling signal with a gradually falling voltage, and a voltage of a scan signal of a negative polarity direction, which are supplied to the scan electrode, using one voltage source.

According to still another aspect of the present invention, there is provided a method of driving a plasma display apparatus comprising: applying a rising signal, which rises from a first voltage to a second voltage, to a scan electrode during a reset period; and applying a scan signal of a magnitude, which equals to a magnitude of a difference between the first voltage and the second voltage, to the scan electrode during an address period.

In the present invention, by forming a width of a bus electrode to be smaller than that of a black layer, edge curl is prevented and thus wall charges can be easily diffused, and black brightness is reduced and thus contrast can be improved.

Furthermore, it is possible to simplify the entire driving and lower a total production cost of a plasma display apparatus.

Furthermore, it is possible to reduce generation of noise.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
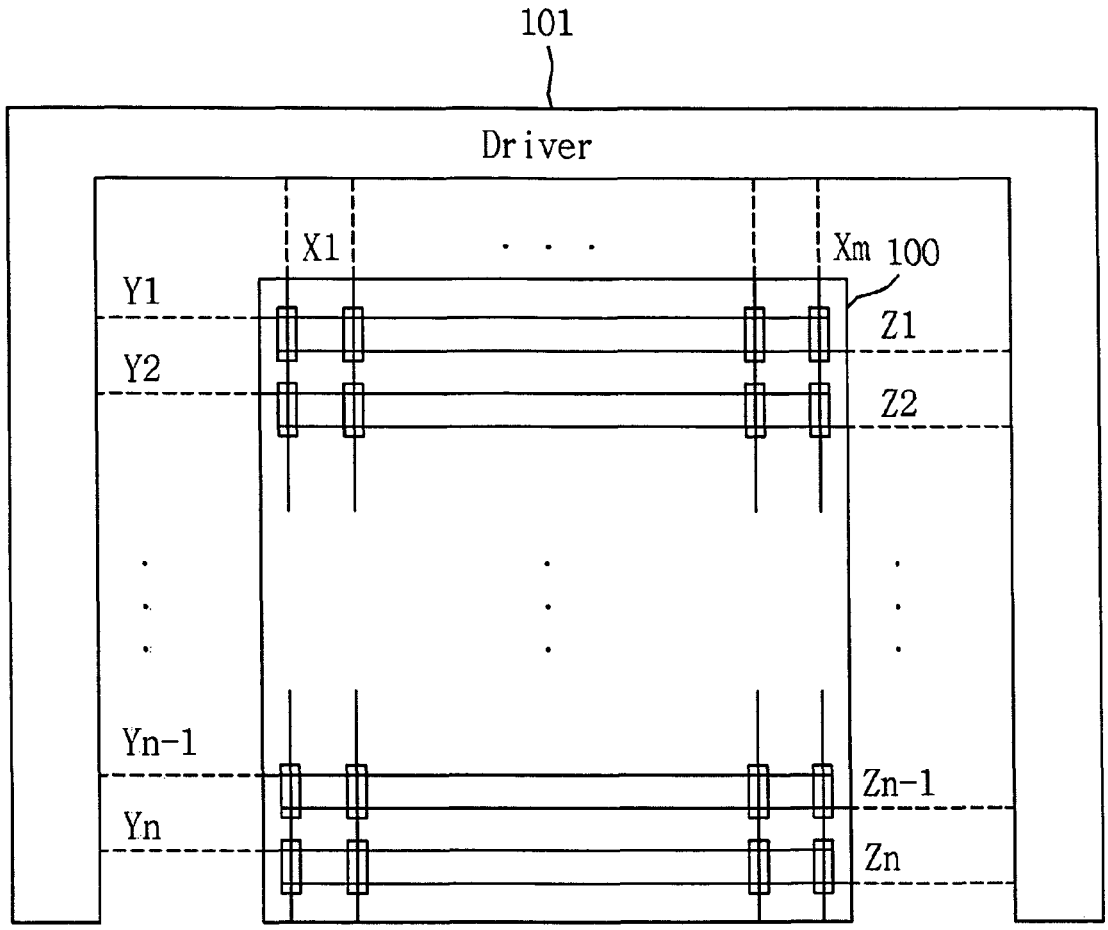
FIG. 1 is a diagram illustrating a plasma display apparatus according to an embodiment of the present invention.

Preferred embodiments of the present invention will be described in a more detailed manner with reference to the drawings.

According to an aspect of the present invention, there is provided a plasma display apparatus comprising: a plasma display panel comprising a scan electrode; and a driver for supplying a voltage of a rising signal with a gradually rising voltage and a voltage of a scan signal of a negative polarity direction, which are supplied to the scan electrode, using one voltage source.

The voltage source may comprise a scan voltage source of a negative polarity direction.

The scan signal of the negative polarity direction may fall from a ground level voltage.

The driver may comprise: a scan voltage supply controlling unit of a negative polarity direction for controlling the voltage of the scan signal of the negative polarity direction supplied to the scan electrode; and a rising signal supply controlling unit for generating and controlling the rising signal using a scan voltage of a negative polarity direction supplied from the scan voltage source of the negative polarity direction.

The rising signal supply controlling unit may comprise: a reverse voltage storing unit for storing a reverse voltage of a polarity direction different from the scan voltage of the negative polarity direction; a reverse voltage supply controlling unit for controlling the storage of the reverse voltage in both ends of the reverse voltage storing unit; and a rising signal generating unit for generating the rising signal using a voltage stored in the reverse voltage storing unit.

One end of the reverse voltage storing unit may be connected to one end of the scan voltage supply controlling unit of the negative polarity direction, the other end of the reverse voltage storing unit may be commonly connected to one end and the other end of the reverse voltage supply controlling unit and one end of the rising signal generating unit, and the other end of the scan voltage supply controlling unit of the negative polarity direction may be grounded.

The plasma display apparatus may further comprise a first reverse blocking unit connected between one end of the reverse voltage supply controlling unit and one end of the reverse voltage storing unit.

The plasma display apparatus may further comprise a second reverse blocking unit connected between a connection end between the other end of the reverse voltage supply controlling unit and one end of the rising signal generating unit and one end of the reverse voltage storing unit.

According to another aspect of the present invention, there is provided a plasma display apparatus comprising: a plasma display panel comprising a scan electrode; and a driver for supplying a voltage of a rising signal with a gradually rising voltage, a voltage of a falling signal with a gradually falling voltage, and a voltage of a scan signal of a negative polarity direction, which are supplied to the scan electrode, using one voltage source.

The voltage source may comprise a scan voltage source of a negative polarity direction.

The scan signal of the negative polarity direction may fall from a ground level voltage.

The driver may comprise: a scan voltage supply controlling unit of a negative polarity direction for controlling the voltage of the scan signal of the negative polarity direction supplied to the scan electrode; a falling signal supply controlling unit for controlling the falling signal supplied to the scan electrode; and a rising signal supply controlling unit for generating and controlling the rising signal using a scan voltage of a negative polarity direction supplied from the scan voltage source of the negative polarity direction.

The rising signal supply controlling unit may comprise: a reverse voltage storing unit for storing a reverse voltage of a polarity direction different from the scan voltage of the negative polarity direction; a reverse voltage supply controlling unit for controlling the storage of the reverse voltage in both ends of the reverse voltage storing unit; and a rising signal generating unit for generating the rising signal using a voltage stored in the reverse voltage storing unit.

One end of the reverse voltage storing unit may be commonly connected to one end of the falling signal supply controlling unit and one end of the scan voltage supply controlling unit of the negative polarity direction, the other end of the reverse voltage storing unit may be commonly connected to one end and the other end of the reverse voltage supply controlling unit and one end of the rising signal generating unit, and the other end of the falling signal supply controlling unit and the other end of the scan voltage supply controlling unit of the negative polarity direction may be grounded.

The plasma display apparatus may further comprise a first reverse blocking unit connected between one end of the reverse voltage supply controlling unit and one end of the reverse voltage storing unit.

The plasma display apparatus may further comprise a second reverse blocking unit connected between a connection end between the other end of the reverse voltage supply controlling unit and one end of the rising signal generating unit and one end of the reverse voltage storing unit.

According to still another aspect of the present invention, there is provided a method of driving a plasma display apparatus comprising: applying a rising signal, which rises from a first voltage to a second voltage, to a scan electrode during a reset period; and applying a scan signal of a magnitude, which equals to a magnitude of a difference between the first voltage and the second voltage, to the scan electrode during an address period.

The scan signal may fall from a ground level voltage.

The first voltage may be a voltage level of a sustain signal.

Hereinafter, preferred embodiments according to the present invention will be described in detail with reference to the attached drawings.

FIG. 1 is a diagram illustrating a plasma display apparatus according to an embodiment of the present invention.

Referring to FIG. 1, the plasma display apparatus according to an embodiment of the present invention comprises a plasma display panel 100 and a driver 101.

FIG. 1 shows one driver 101, but the plasma display apparatus can be provided with a plurality of drivers depending on electrodes formed in the plasma display panel 100.

For example, when an address electrode (X), a scan electrode (Y), and a sustain electrode (Z) are formed in the plasma display panel 100, the driver 101 can be divided into a data driver, a scan driver, and a sustain driver which are not shown.

An example of the plasma display panel will be described with reference to FIG. 2*a* or FIG. 2*b*.

Figure 2A:
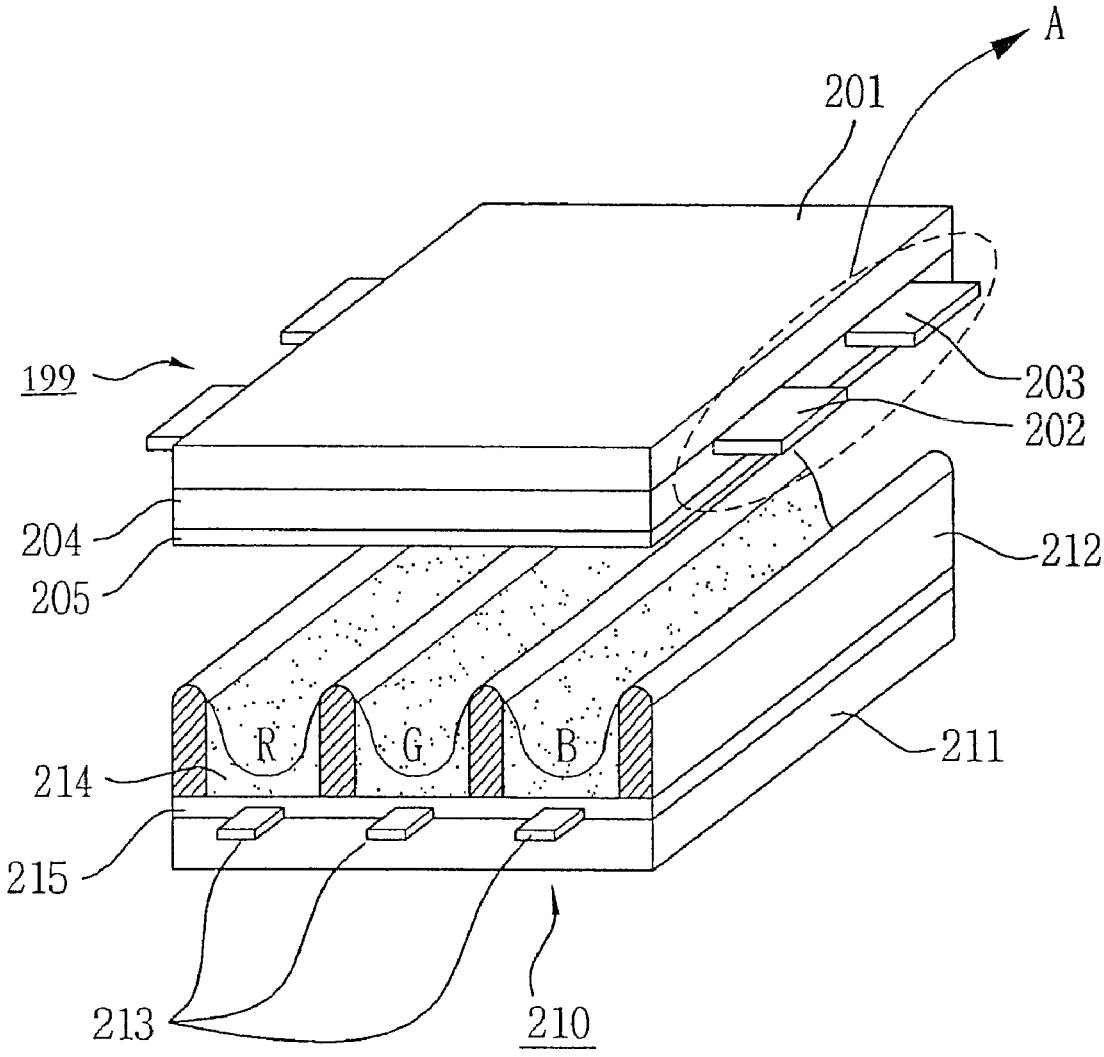
FIG. 2*a* and FIG. 2*b* are views illustrating an example of a plasma display panel comprised in a plasma display apparatus according to an embodiment of the present invention.
Figure 2B:
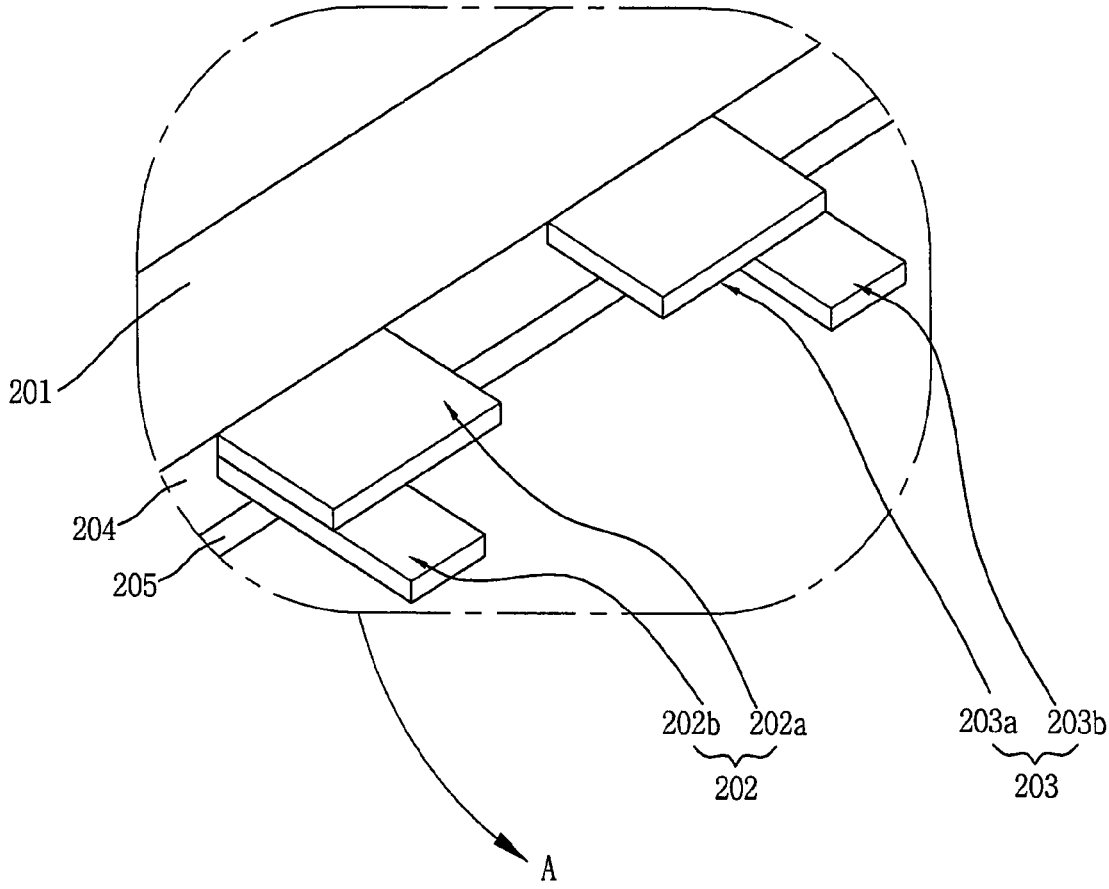

FIG. 2*a* and FIG. 2*b* illustrate an example of the plasma display panel comprised in the plasma display apparatus according to one embodiment of the present invention.

Referring to FIG. 2*a*, in the plasma display panel, a front panel 199 and a rear panel 210 are coupled in parallel to each other at a given distance therebetween. The front panel 199 is formed with scan electrodes 202 (Y) and sustain electrodes 203 (Z) on a front substrate 201, which is a display surface for displaying an image thereon. The rear panel 210 is formed with address electrodes 213 (X) to intersect the scan electrodes 202 and the sustain electrodes 203 on a rear substrate 211 forming a rear surface.

The front panel 199 comprises the scan electrodes 202 and the sustain electrodes 203 which generate a mutual discharge in a discharge space, i.e., a discharge cell and maintain light-emission of discharge cells.

The scan electrode 202 and the sustain electrode 203 are covered with one or more upper dielectric layer 204 which limits a discharge current and provides insulation between the electrode pairs. A protective layer 205 is formed on an upper surface of the upper dielectric layer 204 to facilitate discharge conditions.

The protective layer 205 is formed through a method of depositing with a material such as magnesium oxide MgO in an upper part of the upper dielectric layer 204.

The rear panel 210 comprises a plurality of stripe-type (or well-type) barrier ribs 212 for partitioning a plurality of discharge spaces, i.e., discharge cells. Furthermore, a plurality of address electrodes 213 for supplying a data signal is disposed on the rear panel 210.

Phosphor layers 214, preferably, red color (R), green color (G), and blue color (B) phosphor layers which emit visible light for displaying an image upon performing an address discharge are formed within the discharge cells partitioned by barrier ribs.

A lower dielectric layer 215 for isolating the address electrode 213 is formed between the address electrode 213 and the phosphors 214.

It is preferable that the scan electrode 202 and the sustain electrode 203 are made of a conductive metal material. For example, they can be made of a silver (Ag) material or an indium tin oxide (ITO) material.

Specifically, it is preferable that the scan electrode 202 and the sustain electrode 203 are formed to comprise a bus electrode of a silver material and a transparent electrode of an ITO material in view of light transmittance and electrical conductivity. In FIG. 2*b*, this will be described in detail.

In FIG. 2*b*, as in an area A of FIG. 2*a*, the scan electrode 202 and the sustain electrode 203 are formed between the front substrate 201 and the upper dielectric layer 204.

Referring to FIG. 2*b*, it is preferable that the scan electrode 202 and the sustain electrode 203 of the plasma display panel of the present invention generate a surface discharge, emit light which is generated in the discharge cells to the outside, and comprise transparent electrodes 202*a* and 203*a* made of a transparent ITO material and bus electrodes 202*b* and 203*b* made of a opaque metal material so as to secure driving efficiency.

The reason why the scan electrode 202 and the sustain electrode 203 comprise the transparent electrodes 202*a* and 203*a* is to effectively emit visible light generated within the discharge cells to the outside of the plasma display panel.

Furthermore, the reason why the scan electrode 202 and the sustain electrode 203 comprise the bus electrodes 202*b* and 203*b* is that when the scan electrode 202 and the sustain electrode 203 comprise only the transparent electrodes 202*a* and 203*a*, driving efficiency may be reduced due to low electrical conductivity of the transparent electrodes 202*a* and 203*a* and thus low electrical conductivity of the transparent electrodes 202*a* and 203*a* which may decrease the driving efficiency is compensated.

FIG. 2*a* or FIG. 2*b* illustrates only an example of a plasma display panel among the plasma display apparatus according to an embodiment of the present invention. However, the present invention is not limited to the plasma display panel of a structure of FIG. 2*a* or FIG. 2*b*.

For example, although it is shown only a case where the upper dielectric layer 204 and the lower dielectric layer 215 are formed in one layer, at least one of the upper dielectric layer 204 and the lower dielectric layer 215 can be formed in a plurality of layers.

In the plasma display panel to be applied to the plasma display apparatus of the present invention, the scan electrode 202 is formed and other conditions are the same.

Now, the description of FIG. 2*a* or FIG. 2*b* will be completed and the description of FIG. 1 will be again started.

The driver 101 of FIG. 1 generates a voltage of a ramp-up signal and a ramp-down signal supplied to the scan electrode (Y) in a reset period for initializing and a voltage (−Vy) of a negative scan signal that is supplied to the scan electrode (Y) from one voltage source in an address period after the reset period.

Furthermore, the driver 101 can supply a data signal of a data voltage (Vd) to the address electrode (X) of the plasma display panel 100.

Furthermore, it is preferable that the driver 101 supplies a ramp-up signal, a ramp-down signal, a negative scan signal and a sustain signal to the scan electrode (Y).

Furthermore, it is preferable that the driver 101 supplies a sustain bias voltage (Vz) and a sustain signal to the sustain electrode (Z).

An example of an operation of the plasma display apparatus will be described with reference to FIG. 3.

Figure 3:
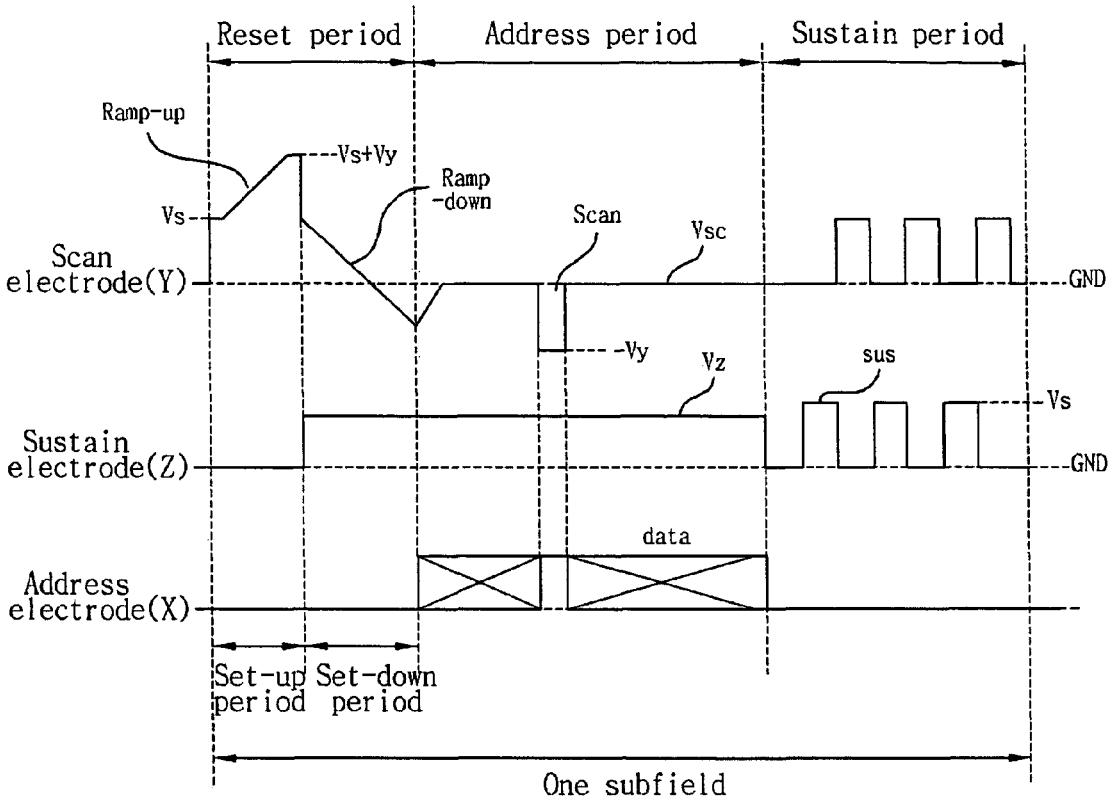
FIG. 3 is a diagram illustrating an example of an operation of the plasma display apparatus according to an embodiment of the present invention.

FIG. 3 is a diagram illustrating an example of an operation of the plasma display apparatus according to an embodiment of the present invention.

FIG. 3 shows a driving signal for using the plasma display apparatus according to an embodiment of the present invention within one subfield.

For example, in a set-up period of the reset period, a ramp-up signal with a gradually rising voltage is supplied to the scan electrode (Y). When it is assumed that the ramp-up signal rises from the sustain voltage (Vs), a magnitude of a maximum voltage of the ramp-up signal is (Vs+Vy).

A weak dark discharge, i.e., a set-up discharge is generated in the discharge cell by the ramp-up signal. By performing the set-up discharge, somewhat wall charges are accumulated within the discharge cell.

Furthermore, in a set-down period after the set-up period, after a ramp-up signal is supplied to the scan electrode (Y), a ramp-down signal with a gradually falling voltage from a predetermined positive voltage lower than a peak voltage of the ramp-up signal is supplied.

A magnitude of a maximum voltage of a ramp-down signal is Vy, which is approximately equal to that of a voltage of the ramp-up signal.

Accordingly, in discharge cells, weak erasing discharge, i.e., a set-down discharges is generated.

By performing the set-down discharge, a part of wall charges accumulated within the discharge cells by the previous set-up discharge is erased and the wall charges uniformly remain within the discharge cells to the degree that there is the generation of a stable address discharge.

A voltage of a negative scan signal (Scan) that falls from a scan reference voltage (Vsc) is supplied to the scan electrode (Y) in an address period after the reset period comprising the set-up period and the set-down period.

A voltage of a negative scan signal is Vy, which is approximately the same voltage as a maximum voltage of the ramp-up signal and a maximum voltage of the ramp-down signal.

More preferably, the scan reference voltage (Vsc) is approximately equal to a voltage of a ground level (GND). That is, a negative scan signal (Scan) falls from a voltage of a ground level.

As described above, a voltage of a negative scan signal, a voltage of a ramp-up signal, and a voltage of a ramp-down signal is generated from one common voltage source.

Accordingly, it is not necessary to separately provide a voltage generating circuit for generating a voltage of a negative scan signal, a voltage of a ramp-up signal, and a voltage of a ramp-down signal. Accordingly, it is possible to simplify the entire driving of the plasma display apparatus according to an embodiment of the present invention and to lower a production cost.

Furthermore, by setting a negative scan signal to fall from a voltage of a ground level (GND), it is not necessary to separately provide another voltage generating circuit to generate a scan reference voltage (Vsc). Accordingly, it is possible to further simplify the entire driving of the plasma display apparatus according to an embodiment of the present invention and to further lower a production cost.

Furthermore, when a voltage (−Vy) of a negative scan signal is supplied to the scan electrode (Y), a voltage (Vd) of a data signal can be supplied to the address electrode (X) to correspond thereto.

On the other hand, it is preferable to supply a sustain bias voltage (Vz) to the sustain electrode (Z) in the address period so as to prevent an erroneous discharge from generating due to interference of the sustain electrode (Z) in the address period.

In the address period, while the voltage difference between a voltage (−Vy) of a negative scan signal and a voltage (Vd) of a data signal is added to a wall voltage by wall charges generated in the reset period, an address discharge is generated within a discharge cell to which a voltage (Vd) of a data signal is supplied.

The wall charges necessary for a sustain discharge when a sustain voltage (Vs) of a sustain signal is supplied are formed within the discharge cells selected by performing the address discharge.

In the sustain period after the address period, a sustain signal (SUS) can be supplied to the scan electrode (Y) and/or the sustain electrode (Z).

Accordingly, while the wall voltage within the discharge cells selected by performing the address discharge is added to the sustain voltage (Vs) of sustain signal (SUS), a sustain discharge, i.e., a display discharge is generated between the scan electrode (Y) and the sustain electrode (Z) whenever the sustain signal (SUS) is applied.

Accordingly, a predetermined image is embodied on the plasma display panel.

An example of a configuration of a driver of the plasma display apparatus according to an embodiment of the present invention for generating the driving signal will be described.

Figure 4:
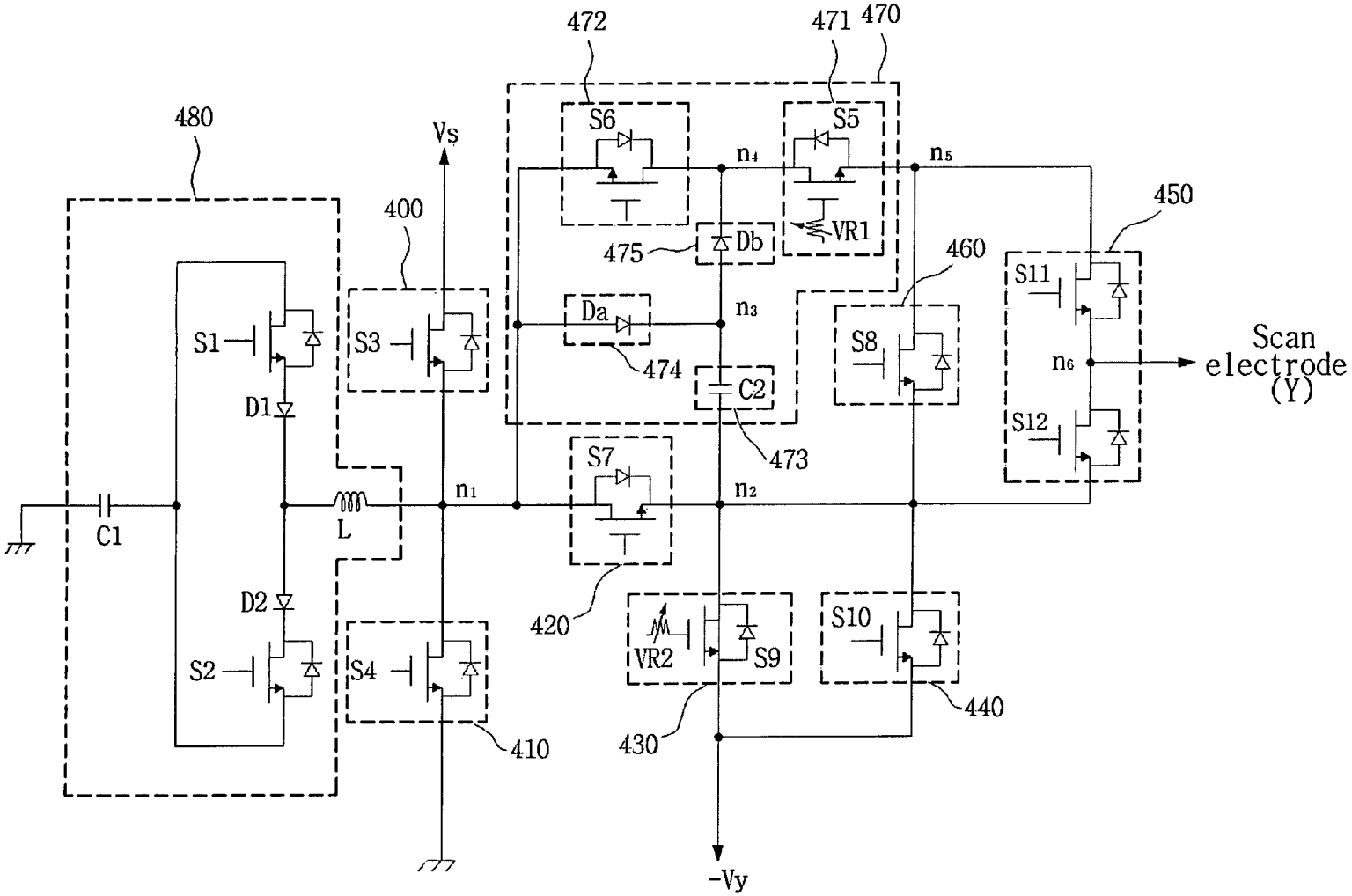
FIG. 4 is a diagram illustrating an example of a configuration of a driver of the plasma display apparatus according to an embodiment of the present invention.

FIG. 4 is a diagram illustrating an example of a configuration of a driver of the plasma display apparatus according to an embodiment of the present invention.

Referring to FIG. 4, it is preferable that the driver of the plasma display apparatus according to an embodiment of the present invention comprises a ground voltage supply controlling unit 410, a negative scan voltage supply controlling unit 440, a ramp-down supply controlling unit 430, a blocking unit 420, a ramp-up supply controlling unit 470, a scan drive integrated circuit 450, and a path selection unit 460.

The ground voltage supply controlling unit 410 comprises a ground voltage supply control switch (S4) and controls a ground voltage (GND) supplied to the scan electrode (Y) using the ground voltage supply control switch (S4).

The negative scan voltage supply controlling unit 440 comprises a negative scan voltage supply control switch (S10) and controls a negative scan voltage (−Vy) supplied to the scan electrode (Y) using the negative scan voltage supply control switch (S10).

The ramp-down supply controlling unit 430 comprises a second variable resistance (VR2) connected to the ramp-down supply control switch (S9) and a gate terminal of the ramp-down supply control switch (S9) and controls a ramp-down signal supplied to the scan electrode (Y) using the ramp-down supply control switch (S9) and the second variable resistance (VR2).

The blocking unit 420 comprises a blocking switch (S7) and intercepts a countercurrent flowing from the ground voltage supply controlling unit 410 to a direction of the negative scan voltage supply controlling unit 440 or the ramp-down supply controlling unit 430 using the blocking switch (S7).

The ramp-up supply controlling unit 470 generates a ramp-up signal using a negative scan voltage (−Vy) and controls the ramp-up signal.

The scan drive integrated circuit 450 comprises a top switch (S11) and a bottom switch (S12) and supplies a ground voltage (GND), a negative scan voltage (−Vy), a ramp-up voltage, and a ramp-down voltage to the scan electrode (Y) through a predetermined switching operation of the top switch (S11) and the bottom switch (S12).

Furthermore, the other end of the top switch (S11) and one end of the bottom switch (S12) are connected to each other in the sixth node (n6) and are connected to the scan electrode (Y) between the other end of the top switch (S11) and one end of the bottom switch (S12).

One end of the top switch (S11) is defined as a first stage of the scan drive integrated circuit 450 and the other end of bottom switch (S12) is defined as a second stage of the scan drive integrated circuit 450.

The path selection unit 460 comprises a path selection switch (S8) and selects a supply path of the scan drive integrated circuit 450 of a ground voltage, a negative scan voltage, a ramp-up voltage, and a ramp-down voltage using the path selection switch (S8).

Preferably, the driver further comprises a sustain voltage supply controlling unit 400 and an energy recovery circuit 480.

The sustain voltage supply controlling unit 400 comprises a sustain voltage supply control switch (S3) and controls a sustain voltage (Vs) that is supplied to the scan electrode (Y) using a sustain voltage supply control switch (S3).

The energy recovery circuit 480 comprises a voltage storing capacitor (C1), a voltage supply switch (S1), a voltage recovery switch (S2), and an inductor (L), supplies a voltage that is previously stored in a voltage storing capacitor (C1) through resonance to the scan electrode (Y) using the voltage storing capacitor (C1), the voltage supply switch (S1), the voltage recovery switch (S2), and the inductor (L), and recovers a reactive voltage of the scan electrode (Y) to the voltage storing capacitor (C1) through resonance.

Now, the ramp-up supply controlling unit 470 will be described in detail.

It is preferable that the ramp-up supply controlling unit 470 comprises a reverse voltage storing unit 473, a reverse voltage supply controlling unit 472, and a ramp-up generator 471.

The reverse voltage storing unit 473 comprises a reverse voltage storing capacitor (C2) and stores the reversed negative scan voltage (−Vy) using the reverse voltage storing capacitor (C2).

The reversed voltage supply controlling unit 472 comprises a reverse voltage supply control switch (S6) and controls so that the reversed negative scan voltage (−Vy) applies in both ends of the reverse voltage storing unit 473 using the reverse voltage supply control switch (S6).

The ramp-up generator 471 comprises a ramp-up generating switch (S5) and a first variable resistance (VR1) connected to a gate terminal of the ramp-up generating switch (S5) and generates a ramp-up signal using a voltage stored in the reverse voltage storing unit 473 using the ramp-up generating switch (S5) and the first variable resistance (VR1).

Here, it is preferable that the other end of the reverse voltage storing unit 473 is commonly connected to the other end of the blocking unit 420, one end of the ramp-down supply controlling unit 430, one end of a negative scan voltage supply controlling unit 440, the other end of path selection unit 460, and a second stage of the scan drive integrated circuit 450, at the second node (n2).

Furthermore, it is preferable that one end of the reverse voltage storing unit 473 is commonly connected to one end of the blocking unit 420, one end and the other end of the reverse voltage supply controlling unit 472, one end of the ramp-up generator 471, and one end of the ground voltage supply controlling unit 410, at the third node (n3).

Specifically, it is preferable that a first countercurrent prevention unit 474 for intercepting a countercurrent flowing from one end of the reverse voltage storing unit 473 to one end of the blocking unit 420, one end of the reverse voltage supply controlling unit 472, and one end of the ground voltage supply controlling unit 410 is further provided between one end of the reverse voltage storing unit 473 and a connection end between one end of the blocking unit 420, one end of the reverse voltage supply controlling unit 472, and one end of the ground voltage supply controlling unit 410.

It is preferable that the first countercurrent prevention unit 474 comprises a first countercurrent prevention diode (Da).

Accordingly, the first node (n1) is provided between one end of the blocking unit 420, one end of the reverse voltage supply controlling unit 472, and one end of the ground voltage supply controlling unit 410.

Furthermore, it is preferable that a second countercurrent interception unit 475 for intercepting a countercurrent flowing from the other end of the reverse voltage supply controlling unit 472 and one end of the ramp-up generator 471 to one end of the reverse voltage storing unit 473 is further provided between one end of the reverse voltage storing unit 473 and a connection end between the other end of the reverse voltage supply controlling unit 472, and one end of the ramp-up generator 471.

It is preferable that the second countercurrent prevention unit 475 comprises the second countercurrent prevention diode (Db).

Accordingly, a fourth node (n4) is provided between the other end of the reverse voltage supply controlling unit 472 and one end of the ramp-up generator 471.

Furthermore, a third node (n3) is provided between the first countercurrent prevention unit 474 and the second countercurrent prevention unit 475.

On the other hand, it is preferable that the other end of the ramp-up generator 471 is commonly connected to one end of the path selection unit 460 and the first stage of the scan drive integrated circuit 450 at the fifth node (n5), and the other end of the ramp-down supply controlling unit 430, the other end of the negative scan voltage supply controlling unit 440, and the other end of the ground voltage supply controlling unit 410 are grounded.

More detailed operation of the ramp-up supply controlling unit 470 will be described with reference to FIG. 5*a* to FIG. 5*c*.

Figure 5A:
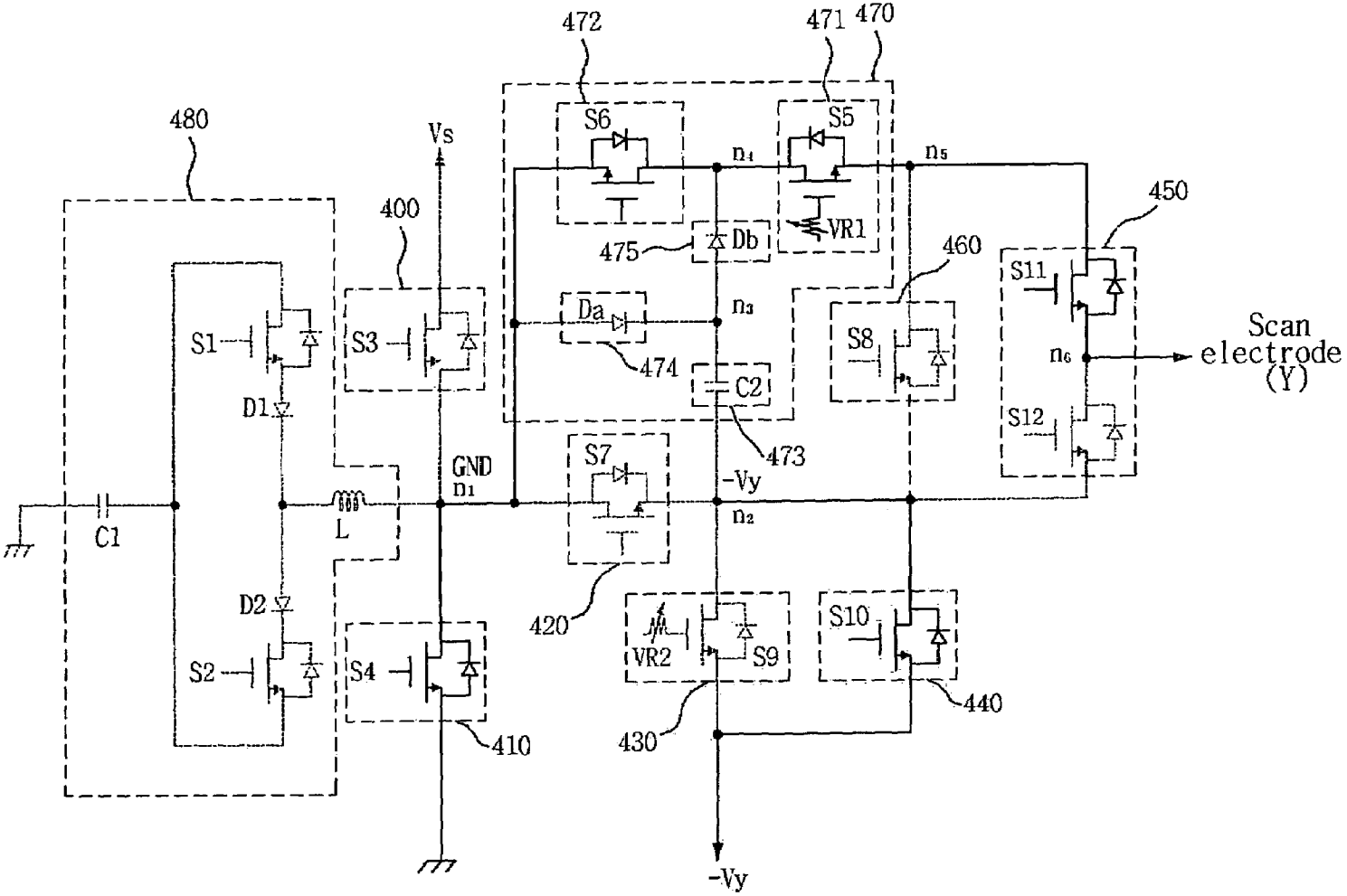
FIG. 5*a* to FIG. 5*c* are diagrams illustrating a more detailed operation of a ramp-up supply controlling unit.
Figure 5B:
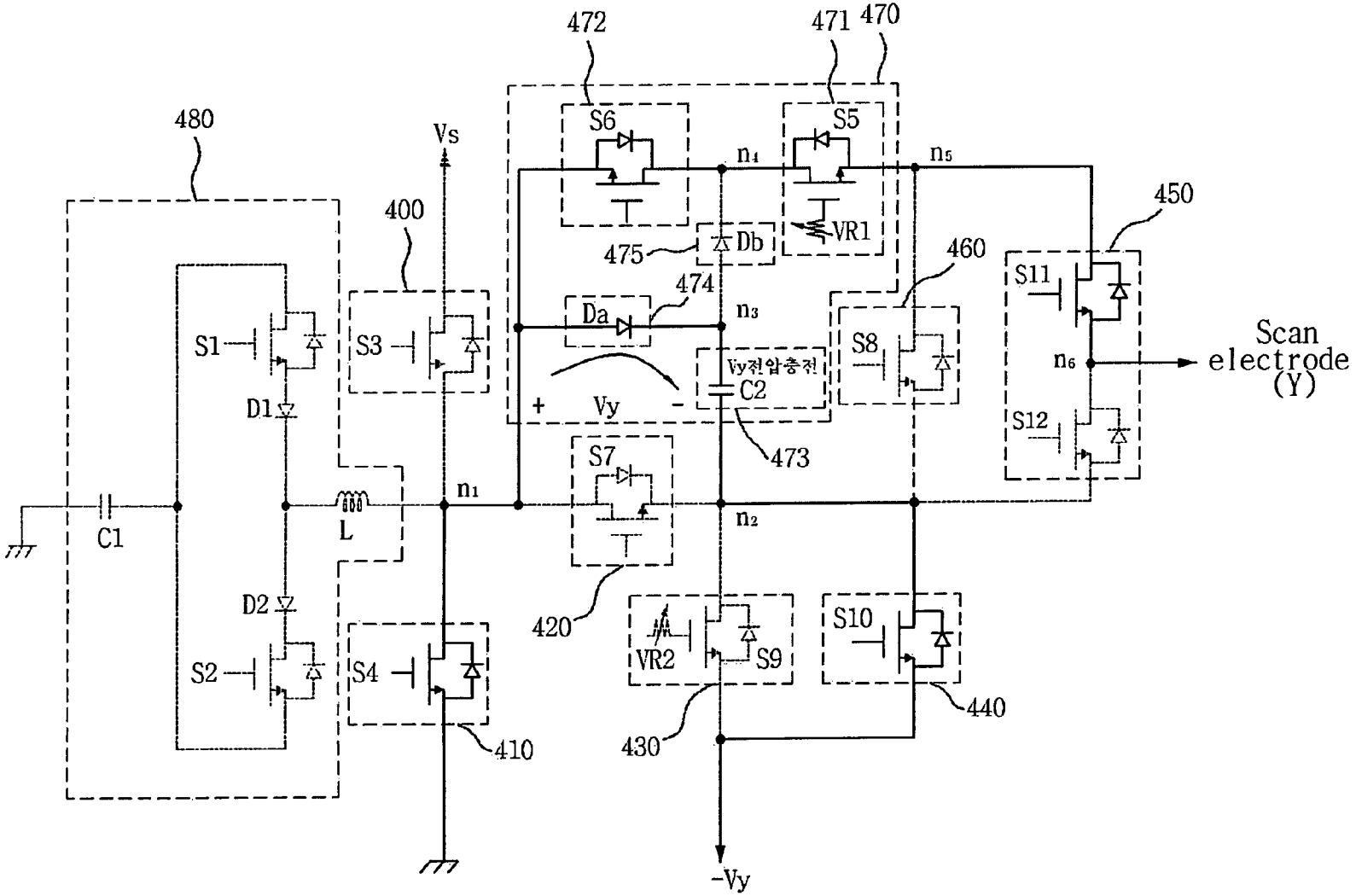
Figure 5C:
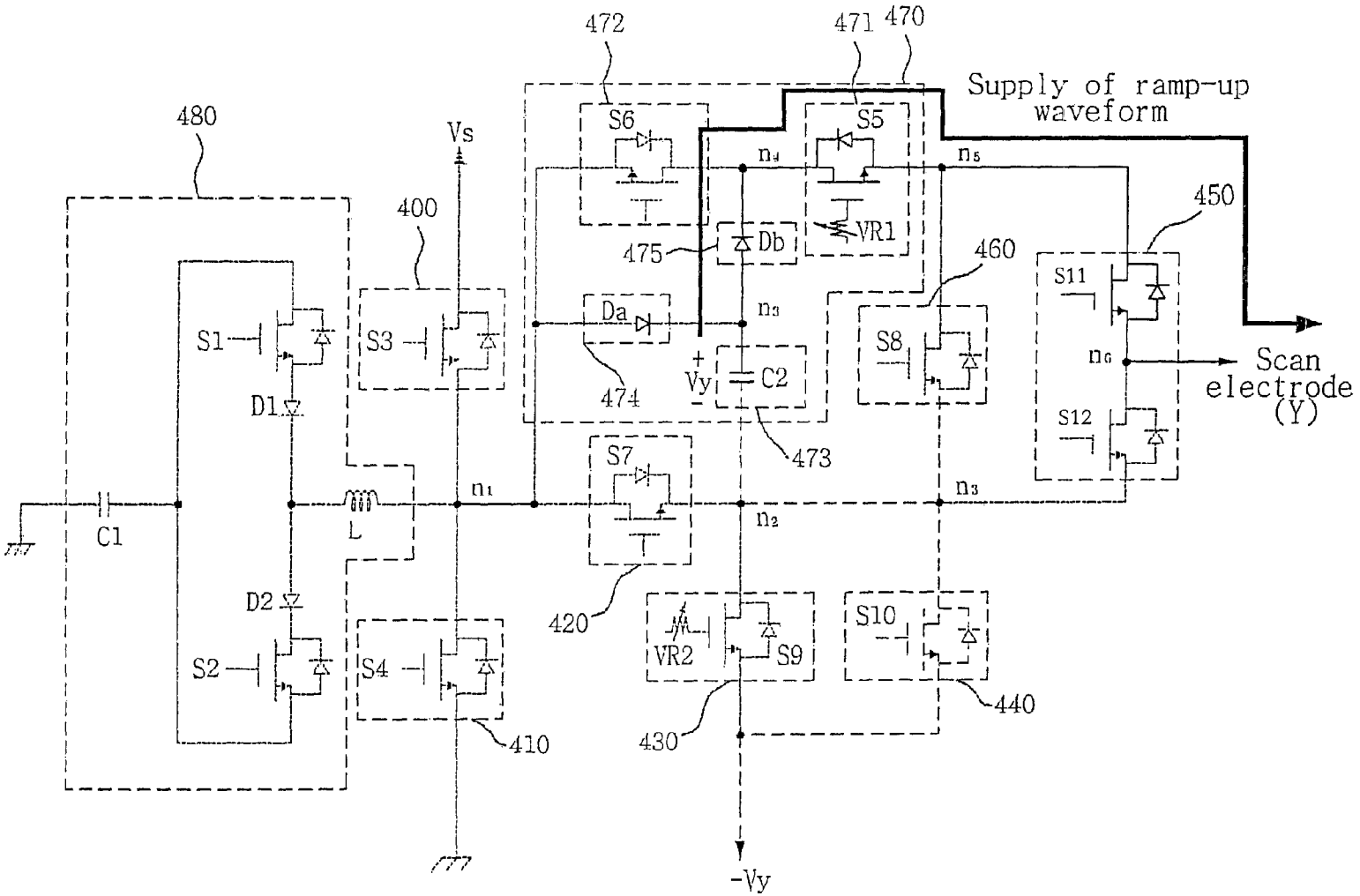

FIG. 5*a* and FIG. 5*c* are diagrams illustrating a more detailed operation of a ramp-up supply controlling unit.

First, referring to FIG. 5*a*, when a negative scan voltage supply controlling unit 440 is turned on, a negative scan voltage (−Vy) supplied from a negative scan voltage source is supplied to the second node (n2) through the negative scan voltage supply controlling unit 440. Accordingly, a voltage of the second node (n2) is set to a negative scan voltage (−Vy).

At this time, when the switches of the ground voltage supply controlling unit 410, the reverse voltage supply controlling unit 472, and the ramp-up generator 471, and a top switch (S11) of the scan drive integrated circuit 450 are turned on, a voltage of a ground level (GND) is supplied to the scan electrode (Y) through the ground voltage supply controlling unit 410, the reverse voltage supply controlling unit 472, the ramp-up generator 471, and the scan drive integrated circuit 450. Accordingly, a voltage of the first node (n1) is set to a voltage of a ground level (GND).

Accordingly, as in FIG. 5*b*, a voltage between both ends of the blocking unit 420 becomes the reversed negative scan voltage (−Vy), and a current path flowing from the first node (n1) to the reverse voltage storing unit 473 through the first countercurrent prevention unit (Da) and the third node (n3) is formed, whereby the reversed negative scan voltage (Vy) is charged to the reverse voltage storing unit 473.

Referring to FIG. 5*b*, it can be seen that a voltage is charged to the reverse voltage storing unit 473 only when the reverse voltage supply controlling unit 472 is turned.

Next, referring to FIG. 5*c*, in a state where the reversed negative scan voltage (Vy) is charged in the reverse voltage storing unit 473, when the switch of the ramp-up generator 471 and the top switch (S11) of the scan drive integrated circuit unit 450 are turned on, a voltage stored in the reverse voltage storing unit 473 is supplied to the scan electrode (Y) via the ramp-up generating switch (S5) of the ramp-up generator 471.

At this time, when a predetermined control signal, i.e., a set up control signal is input to variable resistance, i.e., a first variable resistance (VR1) which is connected to a gate terminal of the ramp-up generating switch (S5), a channel width of the ramp-up generating switch (S5) is adjusted by the first variable resistance (VR1).

Accordingly, a ramp-up signal with a gradually rising voltage is generated and the generated ramp-up signal is supplied to the scan electrode (Y).

FIG. 4 and FIG. 5*a* to FIG. 5*c* illustrate only an example of a driver of the plasma display apparatus according to an embodiment of the present invention, but the present invention is not limited to FIG. 4 and FIG. 5*a* to FIG. 5*c*.

An example of an operation of a driver of the plasma display apparatus according to the present invention will be described.

Figure 6:
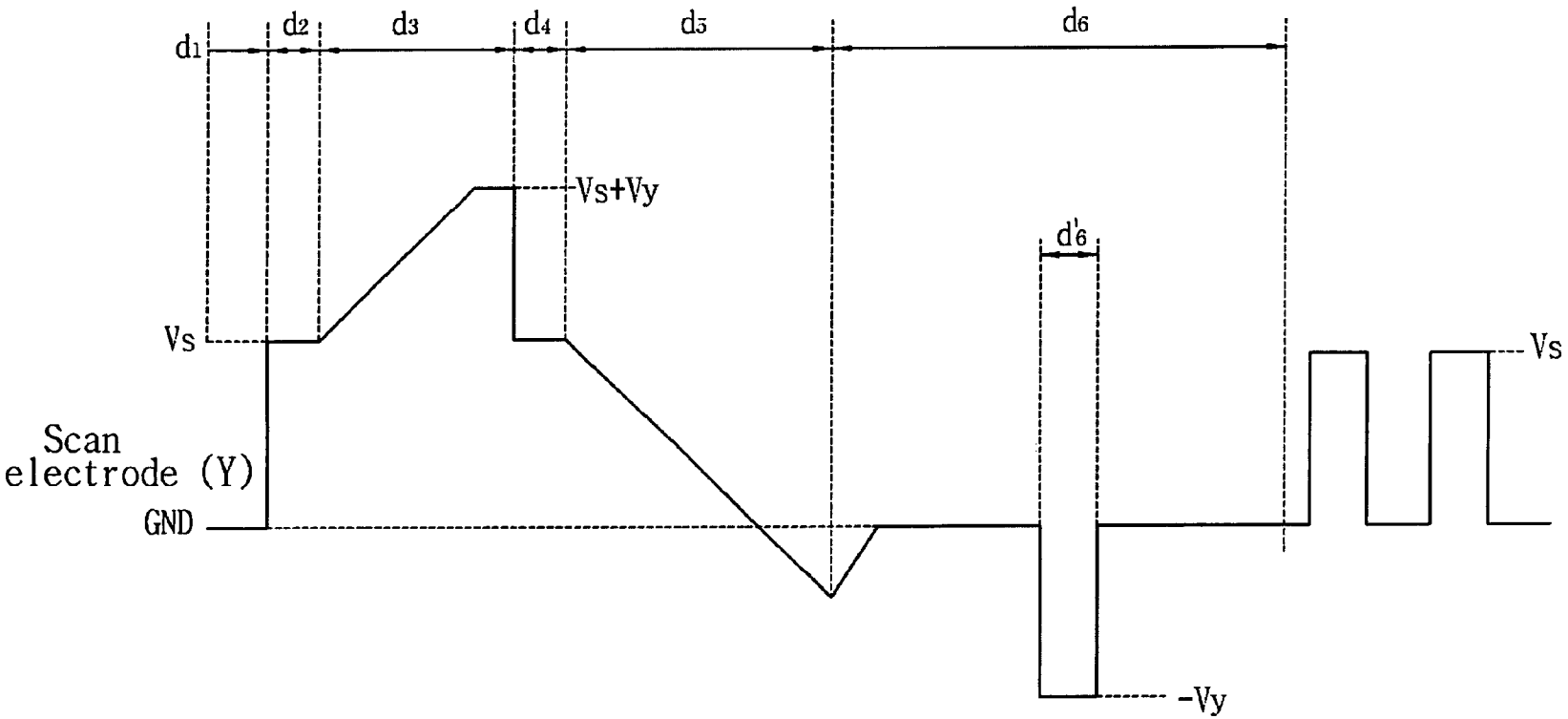
FIG. 6 is a diagram illustrating an example of an operation of a driver of the plasma display apparatus according to an embodiment of the present invention.

FIG. 6 is a diagram illustrating an example of an operation of a driver of the plasma display apparatus according to an embodiment of the present invention. It is assumed that a reversed negative scan voltage (Vy) is stored in the reverse voltage storing unit 473 of FIG. 4.

Referring to FIG. 6, when the ground voltage supply controlling unit 410, the blocking unit 420, and the path selection unit 460 of FIG. 4 are first turned on, a ground voltage is supplied to the scan electrode (Y) of the plasma display panel. Then, in a d1 period, a voltage of the scan electrode (Y) becomes a voltage of a ground level (GND).

Thereafter, when the ground voltage supply controlling unit 410 is turned off and the sustain voltage supply controlling unit 400 is turned on, a voltage (Vs) of a sustain signal is supplied to the scan electrode (Y). Then, in a d2 period, a voltage of the scan electrode (Y) rises up to the sustain voltage (Vs).

Thereafter, a ramp-up signal is supplied to the scan electrode (Y) by a method of FIG. 5*c* described above.

Then, in a d3 period, a voltage of the scan electrode (Y) gradually rises from the sustain voltage (Vs) up to a sum (Vs+Vy) of the sustain voltage (Vs) and the reversed negative scan voltage (Vy).

Thereafter, an operation in a d4 period is equal to that in the d2 period and thus descriptions thereof will be omitted.

Thereafter, the ground voltage supply controlling unit 410, the path selection unit (S8), and the ramp-down supply controlling unit 430 are turned on. At this time, a negative scan voltage (−Vy) supplied from a negative scan voltage source is supplied to the scan electrode (Y) via the ramp-down supply control switch (S9) of the ramp-down supply controlling unit 430.

At this time, when a predetermined control signal, i.e., a set-down control signal is input to a variable resistance, i.e., a second variable resistance (VR2), which is connected to a gate terminal of the ramp-down supply control switch (S9), a channel width of the ramp-down supply control switch (S9) is adjusted by the second variable resistance (VR2). Accordingly, a ramp-down signal with a gradually falling voltage is generated and the generated ramp-down signal is supplied to the scan electrode (Y).

Accordingly, in a d5 period, a voltage of the scan electrode (Y) gradually falls.

Thereafter, in a d6 period, the reversed negative scan voltage (Vy) is stored to the reverse voltage storing unit 473 through the method of FIG. 5*a* or FIG. 5*b* described above.

Furthermore, in a d6 period, a voltage of the scan electrode (Y) maintains a ground level (GND).

However, in a d6' period of the d6 period, when the switches of the negative scan voltage supply controlling unit 440, the ground voltage supply controlling unit 410, the reverse voltage supply controlling unit 472, the ramp-up generator 471, and a bottom switch (S12) of the scan drive integrated circuit 450 are turned on, a negative scan signal (Scan) which falls from a voltage of ground level (GND) is supplied to the scan electrode (Y).

As describe above, in the address period, when a voltage of the scan electrode (Y) is set to a voltage of a ground level (GND) and a negative scan signal is set to fall from a voltage of the ground level (GND), noise which generates in the address period can be reduced. Now, noise reduction will be described in detail.

Figure 7A:
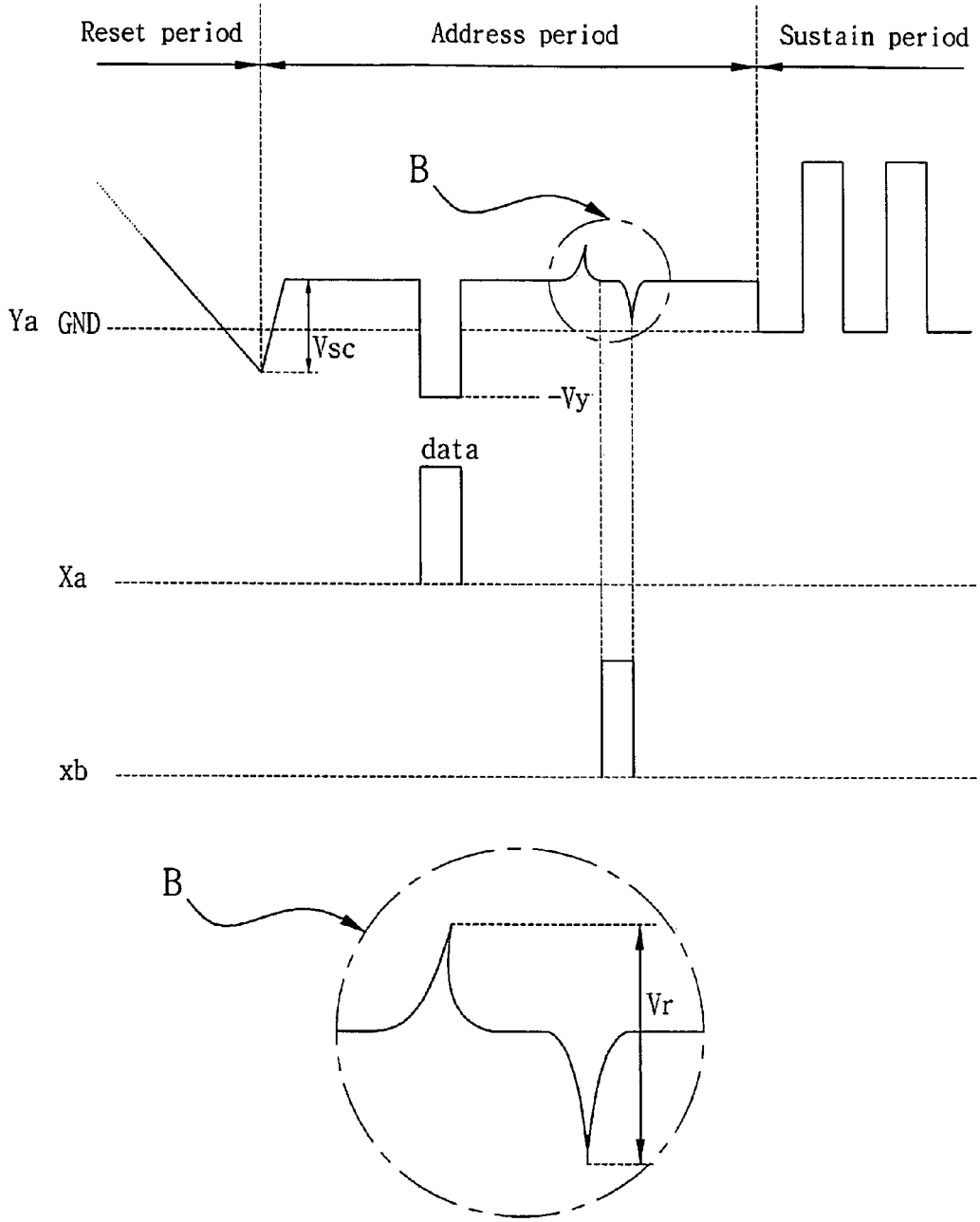
FIG. 7*a* and FIG. 7*b* are diagrams illustrating reduction of a noise generating in address period in the plasma display apparatus according to an embodiment of the present invention.
Figure 7B:
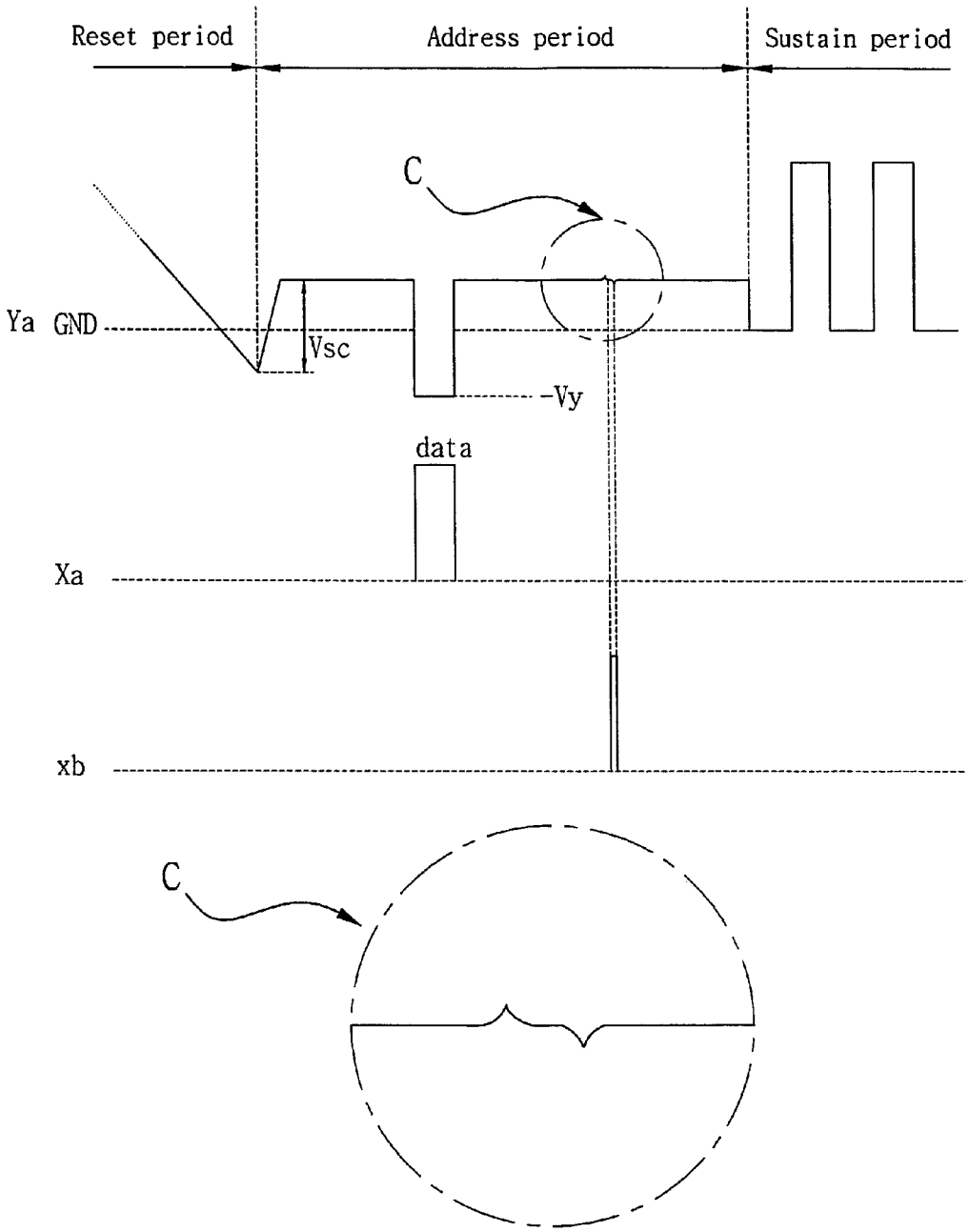

FIG. 7*a* and FIG. 7*b* are diagrams illustrating reduction of a noise generating in address period in the plasma display apparatus according to an embodiment of the present invention.

First, FIG. 7*a* shows a case where a scan reference voltage (Vsc) supplied to the scan electrode (Y) in the address period is a specific voltage of a ground level (GND) or more.

For example, when a scan signal is supplied to a Ya scan electrode in the address period, if a data signal is supplied to a Xa address electrode corresponding thereto in the address period, an address discharge is generated.

Furthermore, a data signal is supplied to the other adjacent address electrode, for example, the Xb address electrode, which does not correspond to the Ya scan electrode. At a time point when the data signal is supplied to the Xb address electrode, noise is generated in the Ya scan electrode by the data signal supplied to the Xb address electrode, as in the area B.

The noise is generated by coupling between the Ya scan electrode and the Xb address electrode and has a relatively large value (Vr), thereby making the entire driving unstable and causing electrical damage of a driver.

Next, FIG. 7*b* shows a case where a scan reference voltage (Vsc) supplied to the scan electrode (Y) in the address period is a ground level (GND) as in the present invention. That is, a negative scan signal falls from a voltage of a ground level (GND).

In this case, the scan reference voltage (Vsc) supplied in the address period is set to a voltage of a ground level (GND), thereby causing coupling between two adjacent scan electrode (Y) and address electrode (X), for example, between the Ya scan electrode and the Xb address electrode. Accordingly, when noise is generated, a noise component flows to the ground (GND).

Therefore, generation of noise is reduced in the address period.

Furthermore, it is possible to simplify the entire driving and lower a total production cost of a plasma display apparatus.

Furthermore, it is possible to reduce generation of noise.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising a scan electrode; and a driver configured to supply a reset signal including a ramp-up signal to the scan electrode during a reset period of a subfield, and a negative polarity scan voltage supplied from a negative polarity scan voltage source, which is different from a sustain voltage source that is to supply a sustain voltage, to the scan electrode during a address period after the reset period of the subfield, wherein:

the driver includes a capacitor and a ramp-up generator having one end directly connected to the capacitor via a countercurrent interceptor and another end directly connected to a scan drive integrated circuit, the capacitor stores the negative polarity scan voltage supplied from the negative polarity scan voltage source, the ramp-up signal, which is generated by the ramp-up generator only using the negative polarity scan voltage stored in the capacitor and the sustain voltage supplied from the sustain voltage source, is applied to the scan electrode during the reset period, and the scan driver integrated circuit controls application of the ramp-up signal generated by the ramp-up generator and the negative polarity scan voltage supplied from the negative polarity scan voltage source to the scan electrode.

2. The plasma display apparatus of claim 1, wherein when the ramp-up signal is supplied to the scan electrode, the negative polarity scan voltage stored in the capacitor is reversed, and then applied to the scan electrode during the reset period.

3. A plasma display apparatus, comprising:

a plasma display panel comprising a scan electrode; and a driver configured to supply a reset signal including a ramp-up signal, which is generated by a ramp-up generator, to the scan electrode during a reset period of a subfield, and a negative polarity scan voltage supplied from a negative polarity scan voltage source, which is different from a sustain voltage source that is to supply a sustain voltage, to the scan electrode during an address period after the reset period of the subfield, wherein:

the driver includes a capacitor, a scan drive integrated circuit, and the ramp-up generator disposed between the capacitor and the scan drive integrated circuit, the capacitor stores the negative polarity scan voltage supplied from the negative polarity scan voltage source, and the ramp-up signal, which is generated by the ramp-up generator only using negative polarity scan voltage stored in the capacitor and the sustain voltage supplied from the sustain voltage source, is applied to the scan electrode during the reset period, and the scan drive integrated circuit controls application of the ramp-up signal and negative polarity scan voltage to the scan electrode.

4. The plasma display apparatus of claim 1, wherein the driver includes: a ramp-down generator having one end directly connected to the capacitor and another end directly connected to the negative polarity scan voltage source.

5. The plasma display apparatus of claim 3, wherein the driver includes: a ramp-down generator having one end directly connected to the capacitor and another end directly connected to the negative polarity scan voltage source.

6. The plasma display apparatus of claim 4, wherein a ramp-down signal generated by the ramp-down generator using the negative polarity scan voltage supplied from the negative polarity scan voltage source is supplied to the scan electrode after the ramp-up signal is supplied during the reset period of the subfield.

7. The plasma display apparatus of claim 5, wherein a ramp-down signal generated by the ramp-down generator using the negative polarity scan voltage supplied from the negative polarity scan voltage source is supplied to the scan electrode after the ramp-up signal is supplied during the reset period of the subfield.

* * * * *